United States Patent [19]

Trützschler

[11] Patent Number: 4,499,633

[45] Date of Patent: Feb. 19, 1985

[54] APPARATUS FOR SEPARATING FIBER TUFTS FROM AN AIRSTREAM

[75] Inventor: Hermann Trützschler, Monchen-Gladbach, Fed. Rep. of Germany

[73] Assignee: Trützschler GmbH & Co. KG, Monchen-Gladbach, Fed. Rep. of Germany

[21] Appl. No.: 578,807

[22] Filed: Feb. 10, 1984

[30] Foreign Application Priority Data

Feb. 10, 1983 [DE] Fed. Rep. of Germany ..... 3304571

[51] Int. Cl.[3] ..... D01G 15/40

[52] U.S. Cl. ..... 19/105; 19/304

[58] Field of Search ..... 19/105, 157, 160, 161.1, 19/163, 304, 308

[56] References Cited

U.S. PATENT DOCUMENTS

| | | | |
|---|---|---|---|
| 3,169,664 | 2/1965 | Meinicke | 19/105 X |
| 3,712,682 | 1/1973 | Binder et al. | 19/105 X |
| 3,728,759 | 4/1973 | Hergeth | 19/105 |
| 4,240,180 | 12/1980 | Wood et al. | 19/105 |
| 4,280,251 | 7/1981 | Ludwig | 19/105 |
| 4,394,790 | 7/1983 | Keller | 19/105 |
| 4,404,710 | 9/1983 | Wood | 19/105 |

FOREIGN PATENT DOCUMENTS

| | | | |
|---|---|---|---|
| 1286436 | 1/1969 | Fed. Rep. of Germany . | |
| 2137139 | 2/1972 | Fed. Rep. of Germany . | |
| 2548320 | 7/1976 | Fed. Rep. of Germany | 19/105 |

*Primary Examiner*—Louis K. Rimrodt

*Attorney, Agent, or Firm*—Spencer & Frank

[57] ABSTRACT

An apparatus for forming a lap from fiber tufts has a generally vertically oriented feed chute having upper and lower ends; a mechanism disposed at the upper end for introducing fiber tufts into the feed chute; a mechanism at the lower end for discharging a lap from the feed chute; a mechanism for maintaining, in the feed chute, an air stream flowing downwardly in the direction of the lower end; and apertured separating walls bounding the feed chute along a vertical length portion thereof for providing an exit for the air stream from the feed chute. Each separating wall has a plurality of parallel-spaced, vertically extending slots and webs in an alternating sequence. The separating walls are in a parallel, face-to-face relationship and are spaced from one another by a distance less than the expected smallest size of the tufts. The slots in one separating wall are staggered in a horizontal direction with respect to the slots in the other separating wall and the width of the slots is greater than the expected largest size of the tufts.

13 Claims, 13 Drawing Figures

FIG. 2
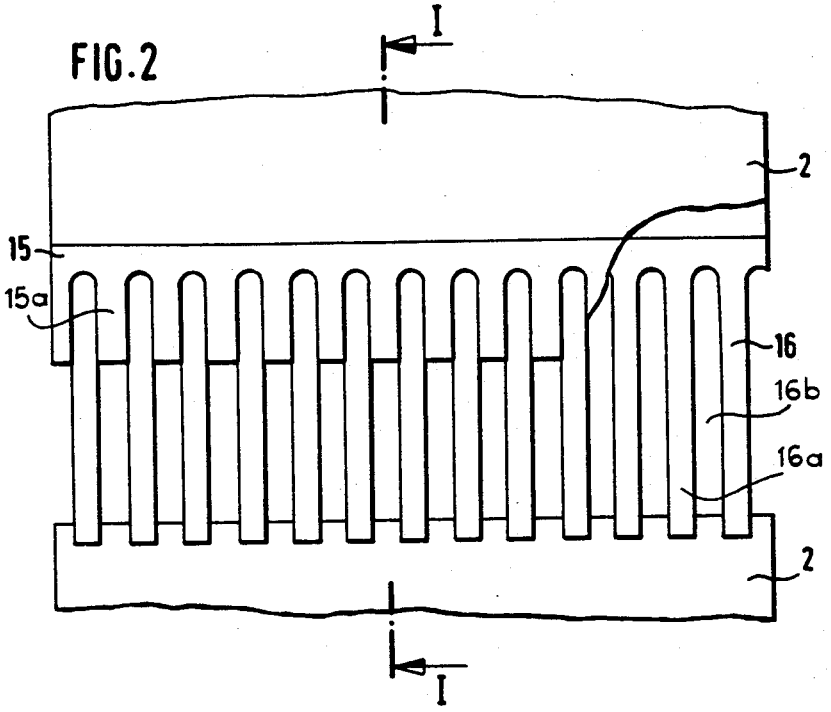
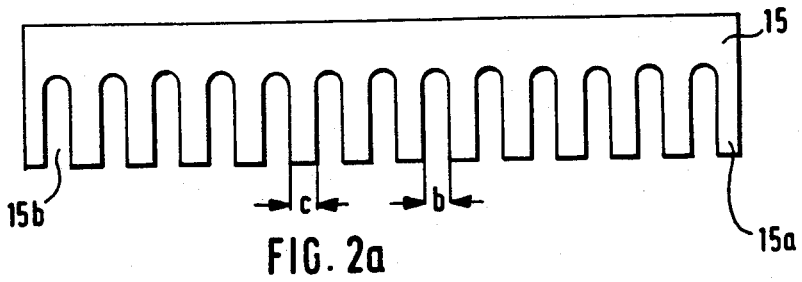
FIG. 2a

FIG.3
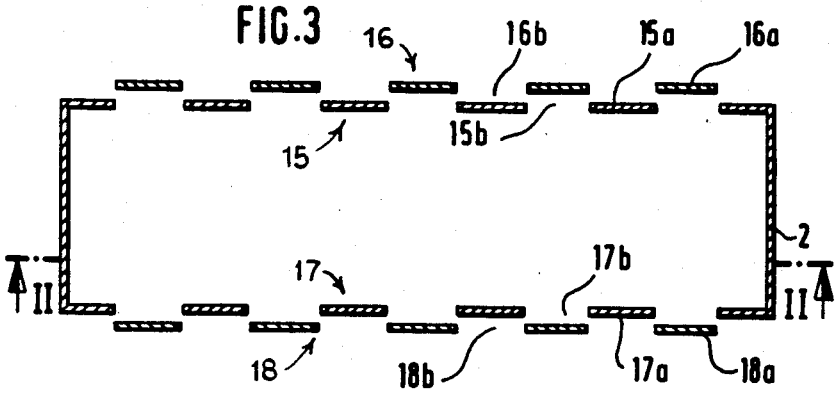
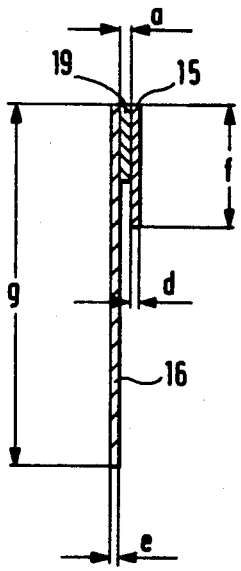
FIG.4a
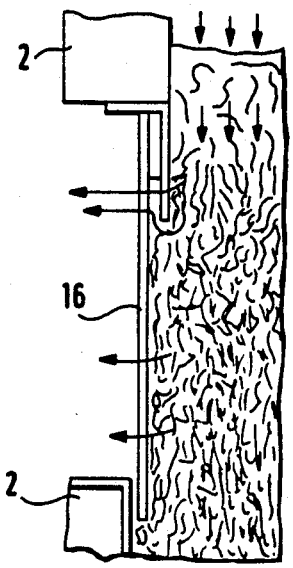
FIG.4b

APPARATUS FOR SEPARATING FIBER TUFTS FROM AN AIRSTREAM

BACKGROUND OF THE INVENTION

This invention relates to an apparatus in which fiber tufts are separated from an airstream and which feeds a lap, for example, to a carding machine. Such an apparatus comprises a feed chute supplied with fiber tufts from a pneumatic conveyor duct coupled to an inlet end of the feed chute. The feed chute has a generally vertical orientation and has at its lower end a delivering device which discharges the tufts from the feed chute as a continuous lap. The feed chute further has, at least on one side, an apertured separating wall through which a downwardly flowing airstream is removed from the feed chute. The separating wall has vertically oriented spaced slots for achieving, over the entire width of the feed chute, a uniform downward progression of a fiber tuft column.

A known apparatus of the above-outlined type is disclosed in German Auslegeschrift (application published after examination) No. 1,286,436. The apparatus disclosed therein has a comb-like separating wall whose narrow vertical slots have a width (for example, 0.5 to 1.5 mm) which is smaller than the expected smallest size of the tufts to be deposited within the chute. By virtue of the width dimension of the slots the fiber tufts are prevented from leaving the feed chute upstream of the delivering device to thus ensure that fiber material will not be lost; rather, the tufts are retained by the teeth of the comb, that is, by the webs between the slots. It is a disadvantage of this arrangement that the narrow slots significantly limit the flow rate of air leaving the feed chute through the separating wall. The degree of compression (densification) and thus a uniformity of the fiber tuft column in the feed chute is, however, dependent upon the product of the speed and the volume of the air flowing in the feed chute, so that a small flow rate of exiting air has an adverse effect on the degree of compression of the fiber tufts.

SUMMARY OF THE INVENTION

It is an object of the invention to provide an improved apparatus of the above-outlined type from which the discussed disadvantages are eliminated and which, in particular, while avoiding fiber losses, permits an increased flow rate of exiting air compared to prior art constructions.

This object and others to become apparent as the specification progresses, are accomplished by the invention, according to which, briefly stated, the feed chute has, along a length portion of at least one side, a separating wall construction formed of at least two face-to-face arranged separating walls each provided with parallel-spaced slots, whereby webs and slots alternate in each separating wall. The web-and-slot arrangement in one separating wall is staggered laterally with respect to the web-and-slot arrangement in the other separating wall and further, the width of the slots in each separating wall is greater than the expected largest size of the tufts, whereas the distance between the separating walls is smaller than the expected smallest size of the tufts.

By virtue of the fact that the width of the slots in the separating walls is selected to be greater than the expected largest size of the fiber tufts, there is achieved a greater flow rate of the exiting air than heretofore possible. In this manner, a greater compression of the tuft column and thus an improved uniformity of the fiber tuft column in the feed chute may be achieved, as compared to conventional constructions.

The fiber tufts are prevented from leaving the feed chute through the separating walls by virtue of the staggered disposition of the separating walls with respect to one another which means that the slots in one separating wall are in registry with the webs of the other, adjoining separating wall. The distance between the separating walls is sufficiently small so that the fiber tufts are not capable of passing through the narrow gaps between adjoining separating walls. The fiber tufts passing through the slots of the inner separating wall (that is, the separating wall which is closer to the feed chute in case two separating walls are used) may be retained in the feed chute by impinging upon the respective webs of the successive (outer) separating wall and, in particular, by combining with the other fiber tufts which form the fiber tuft column in the feed chute. By means of the webs of one separating wall aligned with the slots of the other separating wall an operational malfunction due to clogging of the slots is avoided. Further, the air, as it exits through the slots of the inner separating wall, impinges on, and is thus deflected by the webs of the outer separating wall and, as a result, it loses velocity whereby an entrainment of the fiber tufts is further impeded. By virtue of the velocity reduction of the exiting air no spinning phenomena induced by air turbulences will occur in case of blockage of individual fibers. The invention provides that an increased flow rate of exiting air from the feed chute is possible without loss of tufts and thus the compression of the fiber tufts to form a fiber tuft column within the feed chute is improved.

According to a further feature of the invention, the slots in the separating walls extend downwardly to the lower zone of the feed chute. Expediently, the slots are open in the downward direction, so that the fiber material may easily slide off the comb-like construction. Advantageously, the webs have a width which corresponds to the width of one slot. Preferably, the slots in one separating wall are in alignment with the webs of the adjoining separating walls.

According to a further feature of the invention, the inner separating wall is of shorter vertical length than the outer separating wall whereby in the lower zone of the separating wall construction only a single separating wall is present which is sufficient due to the greater density of the tuft column there. In this manner, the zone where the risks of material jamming are appreciable is significantly reduced and an improved uniformity over the width of the tuft supply as well as improved CV values are achieved. The webs of the shorter separating wall have preferably a length of 20 to 30 mm while the webs of the longer separating wall have a length of 60 to 100 mm. A significant portion of the air exits from the feed chute already at the upper part of the separating walls because there the air outlet velocity is high. Also, at the upper height level of the separating walls the density (extent of compression) of the fiber tufts is relatively small so that due to a slight inner cohesion, the risks of fiber exit are high. In contradistinction, at the height level of the middle and lower zone of the separating walls the fiber tuft density in the feed chute is relatively high and thus the fiber tufts have a relatively strong cohesion which prevents the tufts from being entrained by the airstream through the wide slots. Further, the speed of the exiting air is significantly reduced in the middle and lower zones because of the higher fiber tuft density; this further weakens the tendency of tuft entrainment through the separating wall.

According to a further feature of the invention, an air outlet channel adjoins the separating walls externally of the feed chute and merges in a space in which low air pressure prevails. The air preferably flows in a downward direction in the air outlet channel. The air outlet channel is formed, preferably at the air outlet side of the separating walls, by an air guiding element, for example, a baffle plate such that the air is deflected in the conveying direction of the fiber tufts in the feed chute. The baffle plate which may be a Plexiglass or a metal component, is situated at a small distance, for example, 10 to 20 mm from the outer separating wall. In this manner, the direction of outflowing air is, already in the zone of the separating wall, oriented in the direction of the fiber tuft feed, so that a friction of the fiber tuft column in the comb structure of the separating wall is reduced, thus aiding the fiber tuft conveyance.

According to a further feature of the invention, between the inner and outer separating walls there is arranged a spacer (such as a sheet metal strip) having a thickness of between 0.5 and 2.0 mm.

According to still another feature of the invention, the width of the slots increases in the downward direction, whereby clogged fiber tufts may be easily removed.

BRIEF DESCRIPTION OF THE DRAWINGS

FIG. 2 is a sectional view taken along line II—II of FIG. 3.

FIG. 2*a* is a front elevational view of one component of the structure shown in FIG. 2.

FIG. 3 is a sectional view taken along line III—III of FIG. 1.

FIG. 4*a* is a sectional side elevational view, on an enlarged scale, of a detail of FIG. 1.

FIG. 4*b* is a sectional side elevational view similar to FIG. 4*a*, illustrating directions of air flow through a fiber tuft column.

DESCRIPTION OF THE PREFERRED EMBODIMENTS

Figure 1:
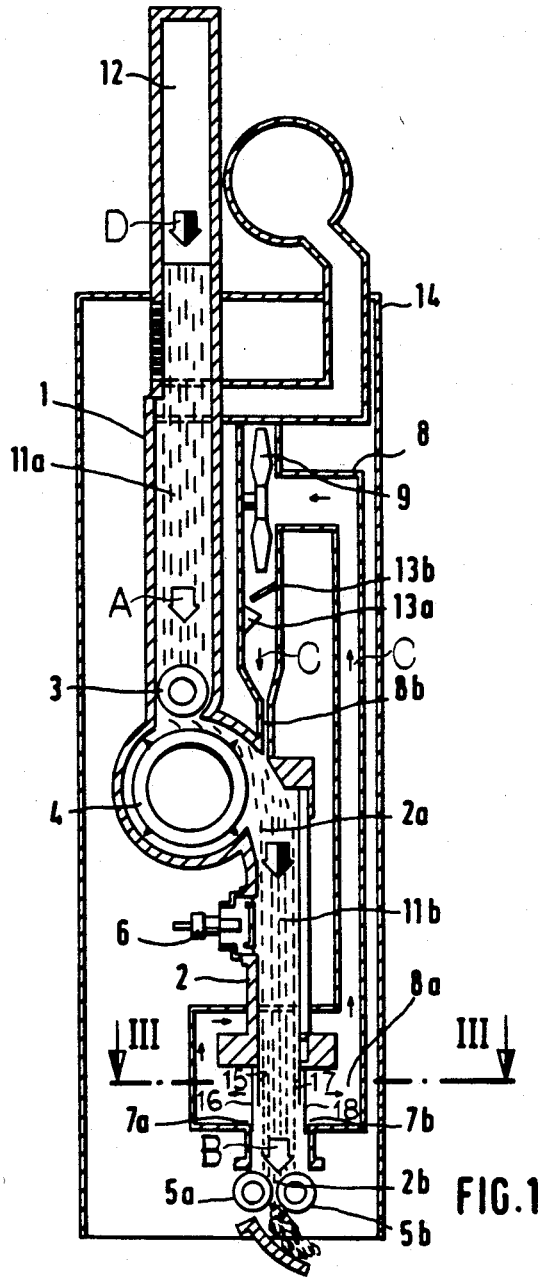
FIG. 1 is a sectional elevational view of a fiber lap delivering feed chute incorporating the invvention.

Turning to FIG. 1, there is shown an apparatus which forms a lap from fiber tufts and feeds the lap to a processing machine, such as a card. The apparatus comprises a reserve chute 1 (upper chute) and a feed chute 2 (lower chute). The feed chute 2 has a rectangular cross section and has a front side and a rear side bounding the vertical shaft of the feed chute at the right and at the left, respectively, as viewed in FIG. 1. The feed chute 2 has an upper open inlet end 2*a* and a lower open outlet end 2*b*. Adjacent the inlet end 2*a* of the feed chute 2 there is arranged a tuft feeding device which comprises a feed roller 3 and an opening roller 4. Underneath the outlet end 2*b* of the feed chute 2 there are arranged two delivery rollers 5*a* and 5*b* which advance a fiber tuft lap, for example, to a carding machine. On the rear wall of the feed chute 2, at an upper portion thereof, there is arranged an electronic pressure-responsive switch 6 that cooperates with a regulator (not shown) and a drive motor (also not shown) for the feed roller 3 for the purpose of regulating the quantities of the fiber tufts admitted to the inlet end 2*a* of the feed chute 2.

Further, the apparatus illustrated in FIG. 1 comprises a closed air circulating system for maintaining a downwardly-oriented air stream in the feed chute 2. The elements of the closed air circulating system comprise apertured wall zones 7*a*, 7*b* which form a length portion of the front and rear walls of the feed chute 2. Externally of the feed chute 2 there is arranged an air duct 8 which has a first end 8*a* surrounding the apertured wall zones 7*a*, 7*b* and communicating with the vertical inner space (shaft) of the feed chute 2 through the apertured wall zones 7*a*, 7*b* and a second end 8*b* which communicates with the shaft of the feed chute 2 through the inlet end 2*a*. In the air duct 8 there is arranged a blower 9 to drive air in a closed circulating path into the feed chute 2 through the inlet end 2*a* and into an air duct 8 through the apertured wall zones 7*a* and 7*b*. The arrows A and B designate the fiber tufts 11*a* in the reserve chute 1 and the fiber tufts 11*b* in the reserve chute 2, the arrows C drawn in the air duct 8 indicate that leg of the circulating air stream which is externally of the feed chute 2, while the arrows D and E designate fiber tufts entrained by an airstream. Above the reserve chute 1 there extends a conveyor duct 12 for the pneumatic transport of fiber tufts from a fine opener (not shown) to the reserve chute 1. It is to be understood that the conveyor duct 12 may supply a plurality of apparatus of the type shown in FIG. 1. Within the air duct 8, between the blower 9 and the end 8*b* there is arranged an air distributing device 13*a*, 13*b* for a uniform distribution of air over the width of the air duct 8. The entire apparatus is accommodated in a housing 14.

Also referring now to FIGS. 2, 2*a* and 3, the apertured wall zone 7*a* on the rear side of the feed chute 2 is formed by an inner separating wall 15 and an outer separating wall 16. The apertured wall zone 7*b* on the front side of the feed chute 2 is formed by an inner separating wall 17 and an outer separating wall 18. The separating walls 15–18 may be of sheet metal having a thickness of 1.5 mm.

Each separating wall 15–18 has a comb-like structure formed of tines (webs) with slots therebetween. Thus, the separating wall 15 has vertical webs 15*a* having a width c of 2.5 to 5 mm, separated by vertical slots 15*b*, having a width b which too, has a magnitude of 2.5 to 5 mm and which is thus greater than the expected maximum size of the fiber tufts in the feed chute 2. The separating walls 16, 17 and 18 are structured similarly to the separating wall 15. The slots of the separating walls 15–18 may be provided by a punching or cutting operation. As particularly well seen in FIG. 3, the slot-and-web arrangement of the separating wall 15 is laterally staggered relative to the slot-and-web arrangement of the separating wall 16 such that the slots 15*b* of the separating wall 15 are in registry with respective webs 16*a* of the separating wall 16 and the slots 16*b* of the separating wall 16 are in registry with respective webs 15*a* of the separating wall 15. The same relationship exists between the webs 17*a*, 18*a* and the slots 17*b*, 18*b* of the separating walls 17 and 18. The slots 15*b* through 18*b* are downwardly open and have a width b which is greater than the expected maximum dimensions of the fiber tufts.

Also referring to FIG. 4*a*, the distance a between the separating walls 15 and 16 as well as between the separating walls 17 and 18 is smaller than the expected smallest size of the fiber tufts in the feed chute 2. The distance a is determined and maintained by a spacer 19 which may be a sheet metal member having a thickness a of 0.5 to 2.0 mm. As may be observed in FIGS. 1, 2 and 4*a*, the separating walls 15 and 17 which are the inner separating walls as viewed from the inner space of the feed chute 2, are shorter in their vertical length than the outer separating walls 16 and 18.

Exemplary specific dimensions of the arrangement according to the invention may be as follows:

| | |
|---|---|
| Width c of the webs 15a through 18a: | 3 mm |
| Width b of the slots 15b through 18b: | 3 mm |
| Distance a (thickness of the spacer 19): | 1.5 mm |
| Thickness d and e of the separating walls 15 through 18: | 1.5 mm |
| Length f of the separating wall 15: | 20 mm |
| Length g of the separating wall 16: | 60 mm |

In case of the above-specified dimensions and geometrical relationships, the minimum width of the passage for the exiting air for each slot 15*b* or 17*b* is 3 mm, since each slot is adjoined on both sides by intermediate spaces (gaps) of a width a of 1.5 mm. These gaps are formed between two webs belonging to adjoining separating walls, as it may be observed in FIG. 3.

The air leaves the fiber tufts in the feed chute 2 through the slots 15*b* and 17*b*, enters into the intermediate space between the webs 15*a* and 16*a* and between the webs 17*a* and 18*a* and then passes through the slots 16*b* and 18*b* into the end 8*a* of the air duct 8. Particularly if the intermediate spaces are relatively narrow between the webs 15*a* and 16*a* and respectively, between the webs 17*a* and 18*a*, that is, they are narrower than the slots 15*b* and 17*b*, respectively, one part of the air does not exit from these intermediate spaces but flows downwardly within the space between the slots 15*b* and the webs 16*a* between the slots 17*b* and the webs 18*a*. In the upward direction each intermediate space is bounded by a respective spacer element 19 and is downwardly open and communicates with the ambient atmosphere or with a suction device.

FIG. 4*b* shows that by virtue of an enlargement of the lower part of the separating walls there is obtained an expansion of the air streaming downwardly through the upper part of the fiber tuft fill so that the pressure of the air at the loction of its exit from the feed chute is reduced. One part of the air may flow upwardly into the narrow intermediate space between the separating walls 15 and 16 and may leave the feed chute 2 through the slots of the separating wall 16.

Figure 5:
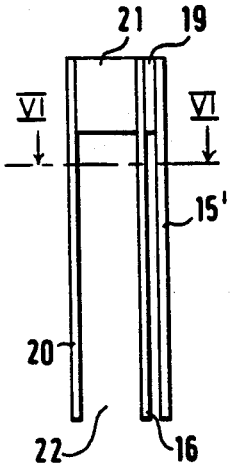
FIG. 5 is a sectional side elevational view of modified components of FIG. 1.
Figure 6:
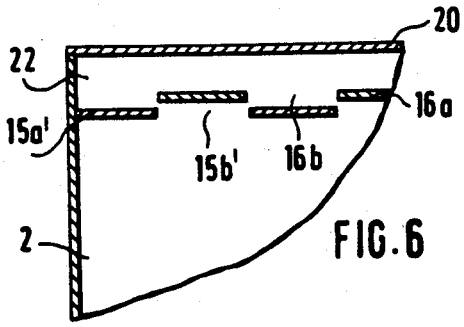
FIG. 6 is a sectional view taken along line VI—VI of FIG. 5.

In the embodiment according to FIGS. 5 and 6, the separating walls 15' and 16 are of identical length. On the air outlet side of the outer separating wall 16 there is provided a closed (that is, non-apertured) guide element 20 such as a sheet metal guide member which is held by means of a spacer 21 at a distance of 10 mm from the separating wall 16. From the feed chute 2 the air passes through the slots 15*b'* into the intermediate space between the webs 15*a'* and 16*a* and then flows through the slots 16*b* into an exit channel 22 bounded by the guide element 20. Within the exit channel 22 the air flows downwardly, that is, in the conveying direction of the fiber tufts in the feed chute 2, into a space (not shown) where a lesser air pressure prevails.

Figure 7:
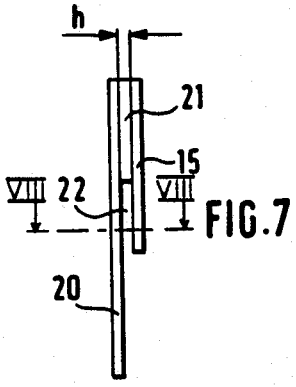
FIG. 7 is a sectional side elevational view of another preferred embodiment of components of the invention.
Figure 8:
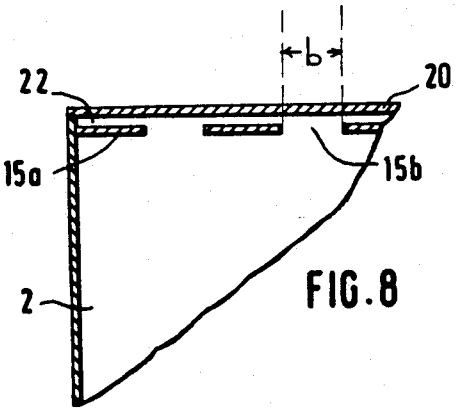
FIG. 8 is a sectional view taken along line VIII—VIII of FIG. 7.

Turning now in FIGS. 7 and 8, in the embodiment illustrated therein there is provided a separating wall 15 whose slots 15*b* have a width b of 3 mm. Between the separating wall 15 and a closed guide element 20 there is provided a spacer 21 such as a sheet metal member having a thickness h of 0.5 to 2.0 mm. In this embodiment the air exits from the fiber tufts in the feed chute 2 through the slots 15*b* into the narrow intermediate space between the webs 15*a* and the guide element 20 and therefrom flows downwardly within the space 22. One part of the air may also flow downwardly in the space between the slots 15*b* and the guide element 20. The space 22 (exit channel) merges into a chamber where a reduced air pressure prevails.

Figure 9:
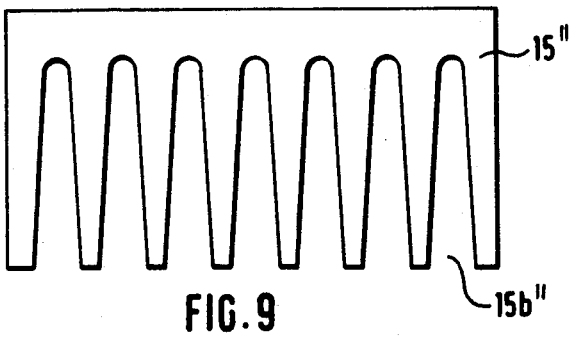
FIG. 9 is a front elevational view of another preferred embodiment of a component of the invention.

According to another preferred embodiment of the invention, the separating walls have downwardly widening slots as illustrated in FIG. 9 in which the separating wall 15'' is shown as having downwardly widening slots 15*b''*.

Figure 10:
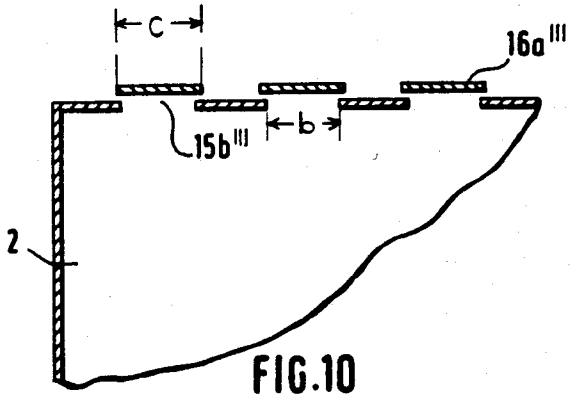
FIG. 10 is a view similar to that of FIG. 3 showing components of modified relative dimensions.

FIG. 10 shows an embodiment in which the width c of the webs 16*a'''* is greater than the width b of the slots 15*b'''*.

Figure 11:
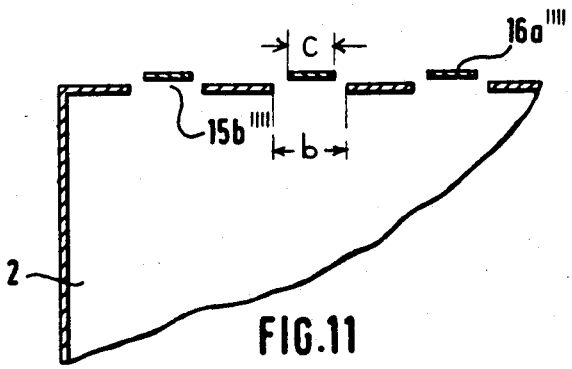
FIG. 11 is a view similar to that of FIG. 10, showing components of modified relative dimensions with respect to those in FIG. 10.

According to the embodiment shown in FIG. 11, the width c of the webs 16*a''''* is smaller than the width b of the slots 15*b''''*.

The arrangement according to the invention may be used in all types of feed chutes for fiber tufts wherein the air flowing through the fiber tufts is to be separated therefrom. Such feed chutes may also find application in tuft cleaning lines for example, for feeding cleaners, openers or the like.

It will be understood that the above description of the present invention is susceptible to various modifications, changes and adaptations, and the same are intended to be comprehended within the meaning and range of equivalents of the appended claims.

What is claimed is:

1. In an apparatus for forming a lap from fiber tufts, including a generally vertically oriented feed chute having upper and lower ends; means disposed at said upper end for introducing fiber tufts into said feed chute; means disposed at said lower end for discharging a lap from said feed chute; means for maintaining, in said feed chute, an air stream flowing downwardly in the direction of said lower end; and apertured wall means bounding said feed chute along a vertical length portion thereof for providing an exit for the air stream from said feed chute; the improvement wherein said apertured wall means includes first and second separating walls each having a plurality of parallel-spaced, vertically extending slots and webs in an alternating sequence; said slots and webs having a vertical length and a horizontal width; said first and second separating walls being in a parallel, face-to-face relationship and being spaced from one another by a distance less than the expected smallest size of the tufts; the slots in said first separating wall being staggered in a horizontal direction with respect to the slots in said second separating wall and the width of said slots being greater than the expected largest size of the tufts.

2. An apparatus as defined in claim 1, wherein said slots extend into a lower zone of said feed chute.

3. An apparatus as defined in claim 1, wherein said slots are open downwardly.

4. An apparatus as defined in claim 1, wherein the width of said slots equals the width of said webs.

5. An apparatus as defined in claim 1, wherein the slots in one of said first and second separating walls are in alignment with the webs of the other of said first and second separating walls.

6. An apparatus as defined in claim 1, wherein said first separating wall is an inner separating wall and said second separating wall is an outer separating wall with respect to said feed chute; and further wherein said first separating wall has a shorter vertical length than said second separating wall.

7. An apparatus as defined in claim 1, further comprising means defining a channel for guiding the air stream in a downward direction immediately upon passage through said apertured wall means from said feed chute.

8. An apparatus as defined in claim 7, wherein said means defining a channel comprises an air guiding element supported externally of said feed chute and in a parallel-spaced relationship with respect to said apertured wall means.

9. An apparatus as defined in claim 1, further comprising a spacer means disposed between said first and second separating walls for maintaining said distance therebetween.

10. An apparatus as defined in claim 1, wherein the width of said slots increases downwardly.

11. An apparatus as defined in claim 1, wherein the width of said webs is greater than the width of said slots.

12. An apparatus as defined in claim 1, wherein the width of said webs is smaller than the width of said slots.

13. In an apparatus for forming a lap from fiber tufts, including a generally vertically oriented feed chute having upper and lower ends; means disposed at said upper end for introducing fiber tufts into said feed chute; means disposed at said lower end for discharging a lap from said feed chute; means for maintaining, in said fed chute, an air stream flowing downwardly in the direction of said lower end; and an apertured separating wall bounding said feed chute along a vertical length portion thereof for providing an exit for the air stream from said feed chute; the improvement wherein said apertured separating wall has a plurality of parallel-spaced, vertically extending slots and webs in an alternating sequence; said slots having a horizontal width greater than the expected largest size of the tufts; and further wherein an air guiding element is supported externally of said feed chute and in a parallel-spaced relationship with respect to said separating wall; said air guiding element and said separating wall together defining a channel for guiding the air stream in a downward direction immediately upon passage through said separating wall from said feed chute; the distance between said air guiding element and said separating wall being less than the expected smallest size of the tufts.

* * * * *